United States Patent [19]

Ohmori et al.

[11] 4,134,441

[45] Jan. 16, 1979

[54] METHOD OF ENLARGING THE STRAND WIDTH OF A STEEL STRAND DURING CONTINUOUS CASTING

[75] Inventors: Hisashi Ohmori; Masayuki Ohnishi; Joshiji Yamamoto, all of Kurashiki, Japan

[73] Assignee: Kawasaki Seitetsu K.K., Kobe, Japan

[21] Appl. No.: 834,987

[22] Filed: Sep. 20, 1977

[30] Foreign Application Priority Data

Sep. 27, 1976 [JP] Japan ..... 51-115535

[51] Int. Cl.[2] ..... B22D 11/06

[52] U.S. Cl. ..... 164/4; 164/82; 164/418

[58] Field of Search ..... 164/435, 436, 82, 154, 164/83, 4, 260, 418

[56] References Cited

U.S. PATENT DOCUMENTS

| | | | |
|---|---|---|---|
| 3,838,730 | 10/1974 | Nagaoka et al. | 164/4 X |
| 3,926,244 | 12/1975 | Meier et al. | 164/4 |
| 4,022,265 | 5/1977 | Takahasi et al. | 164/82 X |

*Primary Examiner*—Richard B. Lazarus
*Assistant Examiner*—John S. Brown
*Attorney, Agent, or Firm*—Werner W. Kleeman

[57] ABSTRACT

A method of widening the width of a continuously cast strand, especially a cast steel strand, comprising the steps of casting a strand in an adjustable continuous casting mold having a first pair of oppositely situated short sides and a second pair of oppositely situated long sides defining therebetween the mold compartment, wherein at least one of the short sides of the mold can be moved during the casting operation. According to the invention, the short side of the mold, during a first stage, is moved away from the continuously cast strand, by rocking or pivoting the same about its lower end region and is brought out of a starting position into an inclined displaced position, then during a second stage this short side is displaced horizontally, in a direction substantially parallel and away from the cast strand, and then during a third stage such short side is moved away from the strand out of the horizontally displaced position into an end position by pivoting or rocking such short side about its upper end region. The displacement speed which is effective during the second stage is dependent upon the relevant prevailing casting speed and chosen such that there is ensured for contact of the cast metal with the entire, imbued surface of such short side.

7 Claims, 5 Drawing Figures

Fig. 1
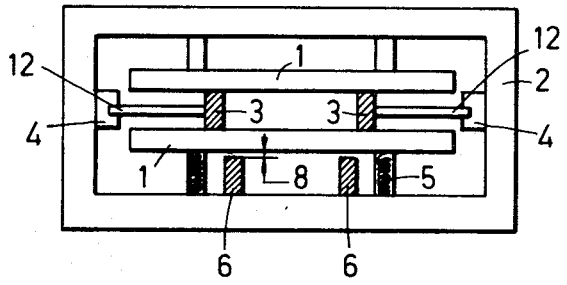
Fig. 3
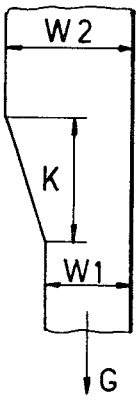
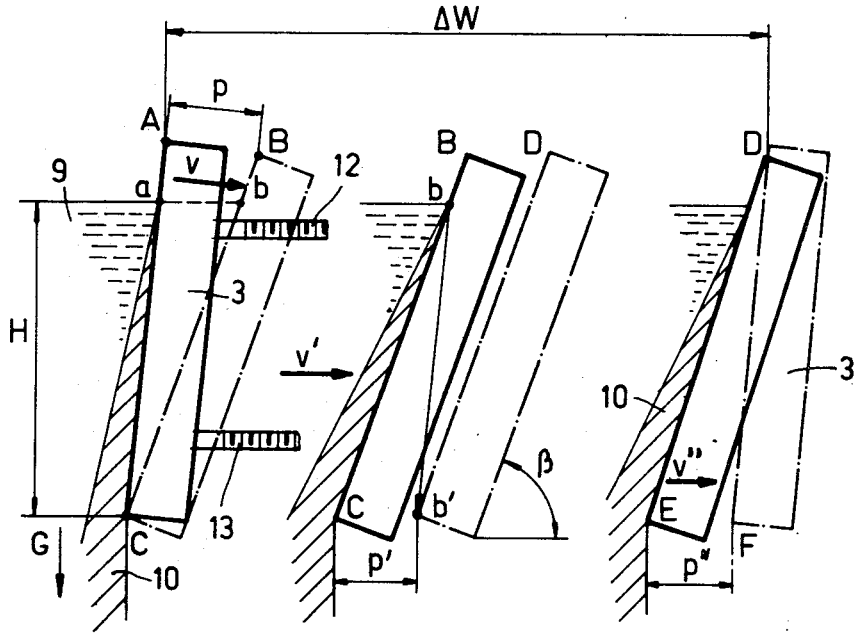
Fig.2a Fig.2b Fig.2c

METHOD OF ENLARGING THE STRAND WIDTH OF A STEEL STRAND DURING CONTINUOUS CASTING

BACKGROUND OF THE INVENTION

The present invention relates to a new and improved method of enlarging the width of a continuously cast strand, especially a steel strand, wherein at least a short or narrow side of an adjustable mold can be moved during the casting operation.

There has already become known to the art an accepted method wherein there is used a continuous casting mold having a short or narrow side which is divided into an upper part and a lower part. During change in the width of the cast strand the upper, non-imbued or non-wetted part is adjusted to a desired extent or position and the withdrawal of the steel strand as well as the oscillation device for the mold is stopped. The bath level in the mold ascends until arriving at the upper part of the mold. After there has been formed an adequate skin thickness at the casting or cast strand, during which the infeed of the melt to the mold at least must be throttled, the lower part is adjusted and the withdrawal of the cast strand can proceed.

Due to stopping the oscillatory motion of the continuous casting mold, it is necessary however to accept a repeated adhesion of the melt with the mold walls. A further drawback which is present with this state-of-the-art technique, resides in the fact that due to bringing the cast steel strand to standstill there is undesirably altered the cooling conditions, something which is unsatisfactory from the metallurgical standpoint, because then there no longer can be ensured for a constant quality of the cast strand over the entire strand length.

Apart from the foregoing, there is also known to the art a method wherein the small or narrow sides of the continuous casting mold are slowly completely retracted, without the need to interrupt the infeed of the melt to the continuous casting mold. Since, however, there can not be avoided the formation of a gap between the strand skin or shell and the small sides of the mold, it is not possible to positively eliminate bowing-out of the casting, and which phenomenon is associated with the danger of metal break-out, within a vertical section formed by the mold. Furthermore, the slow displacement requires an increased expenditure in time during adjustment of the mold, and therefore, a larger transition path, i.e., the region of the width change in the lengthwise direction of the cast strand.

The following numerical values given in the below-listed Table and derived from a conventional method, are useful for underscoring the correlation between the casting speed, displacement speed of the narrow or small side and the magnitude of the bowing-out or bulging of the casting:

| Casting Speed | Speed of Retraction of the Small Side of the Mold | Degree of Bulging |
|---|---|---|
| 0.5 m/min | 5 mm/min | 1 - 2 mm |
| 1.0 m/min | 5 mm/min | 10 - 15 mm |
| 1.0 m/min | 8 mm/min | 15 - 20 mm |

SUMMARY OF THE INVENTION

Hence, with the foregoing in mind it is a primary object of the present invention to provide an improved method of enlarging the width of a cast strand, especially a steel strand, during continuous casting, in a manner not associated with the aforementioned drawbacks and limitations of the prior art proposals.

Another and more specific object of the present invention aims at the provision of a new and improved method of the previously mentioned type, enabling an uninterrupted withdrawal of the cast strand, eliminating, or at the very least substantially minimizing, the danger of bulging- or bowing-out of the soft strand skin or shell throughout the mold length, and finally, requiring a smaller expenditure in time for mold adjustment work.

Now in order to implement these and still further objects of the invention, which will become more readily apparent as the description proceeds, the method of the invention is manifested by the features that the small side of the mold, during a first stage, is displaced away from a starting position into an inclined displaced position by carrying out a pivotal movement of such small side about its lower end region, thereafter, during a second stage, the small side is displaced horizontally in a direction substantially parallel and away from the cast strand, and then, during a third stage, such small side is brought out of the horizontally displaced position into a terminal position, by rocking or pivoting such small side of the mold about its upper end region away from the strand. The displacement speed of the small side of the mold, which is effective during the second stage, is chosen to be dependent upon the momentary or relevant casting speed in such a manner that there is ensured for contact of the cast metal at the entire wetted or imbued surface of such small side of the mold.

This method enables a continuous steady infeed of the melt into the continuous casting mold. Due to the inclined position of the small side there is possible an increased displacement speed. The inclined position also renders possible continuously supporting the strand shell or skin at the mold wall, thereby avoiding bulging of the cast strand at the region of the mold. The withdrawal of the cast strand can be accomplished uniformly during the adjustment of the width of the mold, so that there is obtained a constant steel quality of the cast strand by virtue of the constant cooling conditions. Due to the small time investment needed for adjusting the mold, there is formed only a small transition path, so that the efficiency is improved and the number of rejects in the cast product can be reduced.

Tests have shown that the displacement speed should be chosen so as to advantageously be in the order of between 10 mm/min and 50 mm/min.

Each adjustable small or narrow side of the mold typically possesses an upper and a lower adjustment spindle. In order that the drive motors of such spindles need be only designed for one speed, something which is cheaper and less prone to disturbances, it is advantageous to select the horizontal components of the pivoting speed of the upper and lower end regions, respectively, of the small side of the mold to be equal to the displacement speed.

In order to reduce the formation of fissures and to improve repair of possible fissures, it is furthermore advantageous if the pivotal movements, carried out during the first stage and the third stage, are accomplished at uniform speeds, however always intermittently.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 1 is a top plan view of an adjustable mold useful for the practice of the inventive method;

FIGS. *2a, 2b* and *2c* respectively schematically show different steps during adjustment of the width of the adjustable mold of FIG. 1; and FIG. 3 illustrates a strand section containing a transition path or region.

DETAILED DESCRIPTION OF THE PREFERRED EMBODIMENTS

Describing now the drawings, it is to be understood that only enough of the continuous casting installation has been shown in the drawings, to simplify the illustration, while enabling those skilled in the art to readily understand the underlying concepts and principles of the invention. Turning attention to FIG. 1, there is illustrated therein an adjustable casting mold embodying two parallel long sides 1 and arranged in a fixed frame 2. Two parallel narrow or small sides 3, in other words mold wall parts which are movable laterally between a pair of other mold wall parts extend at right angles to the long sides 1 of the mold. Hence, the mold 1, 3 will be seen to comprise a first pair of oppositely situated long sides 1 and a second pair of oppositely situated short or narrow sides 3 which define therebetween a not particularly referenced conventional mold compartment, with the short sides 3 extending transversely with respect to the long sides 1, as best seen by referring to FIG. 1. Threaded spindles 12, 13 are provided, in the embodiment under discussion, for each short side 3, as best seen by referring to FIG. *2a*, and these threaded spindles operatively connect the related short side 3 with an adjustment device 4, for instance a driven nut or equivalent member. Prior to carrying out the actual adjustment of one or both short sides 3 of the mold 1, 3, it will be apparent that the fixation of the short sides 3 with respect to the long sides 1 must be loosened to a certain extent. To this end the means for fixing the long sides 1 against the short sides 3, which fixation means may be for instance conventional clamping devices, hydraulic cylinders or springs, as generally indicated by reference character 5, must be somewhat relieved or loosened in conventional fashion and the ferrostatic pressure then presses the adjustable long side 1, appearing at the bottom of FIG. 1, against the associated stops or impact members 6. It has been found that the adjustable long side 1 can be displaced at most through a distance 8 of about 0.5 mm, without there existing the danger that melt will penetrate between the joints or interfaces between the long sides 1 and the short sides 3.

Turning attention now to FIG. *2a*, there is illustrated therein a first stage, during which a small side 3 of the mold is pivoted out of a possibly vertical starting or initial position, away from the cast strand 10, into an inclined displaced position, shown in phantom lines. The pivot axis extends through the lower, horizontal edge C of the small side 3 and which edge C bears against the strand 10. The displacement path p, through which a point A at the upper end and at the inside wall of the small side 3 shifts from the starting position to assume a position indicated by the point B of the displacement position, should not be too great due to the danger of overflow of the mold 1, 3. The pivotal movement A-B is advantageously carried out intermittently, for instance in that the upper spindle 12 is preferably stopped three times (during the first stage the lower spindle 13 remains at standstill) so that a point a of the uppermost tip of the strand shell or skin, which tip bears at the inner wall or inside surface of the small side 3, and also the bath level of the metal melt 9 can arrive at a point b without danger of formation of fissures or cracks at the cast strand 10. The height of the molten bath H in the mold 1, 3 and the withdrawal speed G of the strand 10 is not changed. The linear pivoting or pivotal speed v of the small side 3, and which is essentially horizontally directed, should not for practical reasons exceed 50 mm/min and preferably should amount to 20 mm/min.

During the second stage of the short side-mold wall adjustment which has been illustrated in FIG. *2b*, the short or narrow side 3 is displaced horizontally and in a plane parallel to the strand 10 away from the latter, as shown by the phantom or broken line illustration of such FIG. *2b*. To this end, both of the threaded spindles 12, 13 are simultaneously placed into rotation and are in operation for such length of time until there has been obtained the desired new strand width W2 which is a composite of the starting width W1 and the amount of the strand enlargement or widening $\Delta W$. In order that the entire wetted or imbued surface of the small side 3, illustrated by the line section b-C in the vertical sectional showing of FIG. *2a*, is continuously supported during this second stage, i.e. to ensure that the strand shell or skin continously bears against the short side 3, there must be maintained the following theoretical relationship between the horizontal displacement speed v' and the withdrawal speed G: $v' \leqq G \times \tan\beta$, wherein $\beta$ constitutes the angle which the small side 3 encloses in such displaced position with the horizontal. In practice, however, this value v' must be chosen to be considerably smaller, because other factors, for instance the shrinkage of the strand shell or skin, must be taken into account. The point b then also does not follow any vertical path, rather moves, due to such shrinkage or contraction, somewhat towards the left of the showing of FIG. *2b* (line section b-b' in FIG. *2b*). Following a displacement path p' of the small or narrow side 3, wherein the side D-b' remains parallel to the side B-C, the point b' must still bear against the small side 3. Applying the foregoing to the first stage, while presupposing a continuous, constant pivotal speed v, results in the following relationship:

$$v/G = p/H = \tan\beta$$

During the third stage, which has been illustrated in FIG. *2c*, the lower end region of the mold-small side 3 is pivoted about the upper end region, opposite to the pivotal movement carried out during the first stage, in counter-clockwise direction, so that this small side 3 is shifted from the displaced position D-E into the end or terminal position D-F, and it is here to be mentioned that the inclined position D-F of FIG. *2c* need not be identical with the inclined position A-C of FIG. *2a*. The end or terminal position of the small side 3 of the mold 1, 3 even can be vertical. The pivotal movement is accomplished by rotating the related spindle 13, whereas during this time the other threaded spindle 12 is at standstill. The threaded spindles 12, 13 only have one rotational speed so that the horizontal component of the pivotal speed v of the first stage, the displaced or displacement speed v' of the second stage, and the horizontal component of the pivotal speed v'' of the third stage, are all identical to one another.

During a test or trial, wherein the strand withdrawal speed G = 1.0 m/min and the bath level height H = 600 mm, the initial strand width W1 = 1200 mm was increased by ΔW = 100 mm to the new strand width W2 = 1300 mm (FIG. 3). During the preparatory stage the gap 8 was maintained at 0.2 mm. The pivot path p amounted to 9 mm and the speeds v, v' and v'' each amounted to 15 mm/min. In order to carry out the width adjustment of the casting there was required 6 minutes and 50 seconds and the transition section or path K (FIG. 3) amounted to 7000 mm.

While there are shown and described present preferred embodiments of the invention, it is to be distinctly understood that the invention is not limited thereto, but may be otherwise variously embodied and practiced within the scope of the following claims. Accordingly,

What we claim is:

1. A method of widening the width of a continuously cast strand, especially a steel strand, comprising the steps of:

providing an adjustable continuous casting mold having a first pair of opposed small sides and a second pair of opposed long sides defining therebetween the mold compartment for the continuous casting of the strand;

during a first stage, and while the casting operation is in progress, displacing at least one small side of the mold away from a starting position into an inclined displaced position by pivoting said one small side about its lower end region away from the strand;

thereafter, during a second stage, substantially horizontally displacing said one small side away from and essentially parallel to the strand;

then, during a third stage, bringing said one small side out of the horizontally displaced disposition into a terminal position, by pivoting said one small side about its upper end region; and selecting the displacement speed of the one small side which is effective during the second stage to be dependent upon the momentary casting speed in such a manner that there is ensured for contact of the cast metal at the entire, imbued surface of such side.

2. The method as defined in claim 1, further including the step of:

selecting said displacement speed to be in the order of magnitude between about 10 mm/min and 50 mm/min.

3. The method as defined in claim 1, further including the steps of:

selecting the horizontal components of the pivotal speed of the upper end region and the lower end region of said one small side to be equal to the displacement speed.

4. The method as defined in claim 1, further including the steps of:

carrying out the pivotal movement of said one small side during the first stage and the third stage at the same speeds, but intermittently.

5. The method as defined in claim 1, further including the steps of:

releasing a clamping action exerted by at least one of the long sides of the mold upon the short sides thereof, prior to initiation of the first stage operation, so as to enable movement of at least said one short side.

6. The method as defined in claim 5, wherein:

said one long side is displaced away from said short sides by an amount not exceeding about 0.5 mm.

7. The method as defined in claim 1, further including the steps of:

maintaining the height of the molten bath in the mold and the withdrawal speed of the strand essentially constant during the first stage.

* * * * *